US007322365B2

(12) United States Patent
Kelloyan

(10) Patent No.: US 7,322,365 B2
(45) Date of Patent: Jan. 29, 2008

(54) CHANNEL COLORING SYSTEM

(76) Inventor: George Kelloyan, 94 Winsor Ave., Watertown, MA (US) 02472

( * ) Notice: Subject to any disclaimer, the term of this patent is extended or adjusted under 35 U.S.C. 154(b) by 329 days.

(21) Appl. No.: 11/155,176

(22) Filed: Jun. 17, 2005

(65) Prior Publication Data

US 2006/0283472 A1 Dec. 21, 2006

(51) Int. Cl.
*A45D 7/00* (2006.01)
*A45D 24/00* (2006.01)

(52) U.S. Cl. ..... 132/200

(58) Field of Classification Search ..... 132/120, 132/139, 207, 208, 124, 148, 150, 200; D4/117
See application file for complete search history.

(56) References Cited

U.S. PATENT DOCUMENTS 2,272,151 A * 2/1942 Hertzberg ..... 132/120
D137,637 S * 4/1944 Nelson et al. ..... D4/117
D183,167 S * 7/1958 Gore ..... D4/117
3,715,038 A * 2/1973 Winkler ..... 211/128.1
D236,296 S * 8/1975 Hyman ..... D4/117
D268,225 S * 3/1983 Ellenson ..... D4/117
5,819,960 A * 10/1998 Bonazza ..... 211/133.1
6,109,273 A * 8/2000 Schleicher ..... 132/200
D466,306 S * 12/2002 Skwarek et al. ..... D4/117

* cited by examiner

*Primary Examiner*—Robyn Doan

(57) ABSTRACT

The hair coloring system of the present invention comprises a tray that includes three to five color channels, open square bowls for single brushes and an open slot in which brush handles may be placed for storing a number of brushes. Different colors may be squeezed into the channels along with the appropriate mixing solution. A coloring brush is also provided that comprises a handle, hair pick, comb, and brush. The brush portion includes segregated tufts of bristles that correspond to the color channels. The brush may be used to divide the hair into sections, mix the colors, and then to apply the colors to the hair. In this way a single brush and tray combination can do what previously required many different instruments.

7 Claims, 4 Drawing Sheets

CHANNEL COLORING SYSTEM

BACKGROUND

1. Field of the Invention

The present invention relates generally to the field of hair treatment products, and more particularly to a channel coloring system.

2. Description of Related Art

Personal appearance may well be one of the most important and definitive statements an individual can showcase to the world. It is the first thing that others sense about another person; and it is often used to make a variety of assumptions about that person, whether those assumptions are correct or not. Needless to say, a great number of people are concerned with how they appear to others. In this vein, people alternatively attempt to conform their looks to some standard, or attempt to differentiate their appearance away from what is considered the norm.

One of the ways individuals may enhance or alter their appearance is through the style and color of their hair. Many individuals, both male and female, style their hair with shapes and color to achieve a desired look. Not surprisingly, the quantity of hair styling products, salons and hair styling professionals is great.

A number of prior art solutions have been proposed to achieve certain hair styles and colors. Some of the solutions incorporate various brushes, chemicals, cleaners and conditioners as well as specialized techniques, and are discussed in further detail below.

Breitenbach, U.S. Pat. No. 1,689,855 discloses a striping brush for painting substantially parallel lines. The brush includes a casing that divides the bristles of a standard brush thereby providing the desired bristle arrangement. Also provided is a tray that includes an outer casing in which a number of individual channels may be placed. The number of channels corresponds to the desired brush configuration.

Poole, et al., U.S. Pat. No. 3,349,781 discloses a method for hair coloring and an associated apparatus. The applicator used in the process includes a spaced series of bristle tufts. The preferred method allows for one stroke of the applicator to provide the desired colorant. The specification also discloses that different tuft arrangements of the brush may be employed, i.e. any different numbers and widths.

Wong, U.S. Pat. No. 5,337,765 discloses a so-called modular brush for streaking hair that includes a number of bristle modules. In one embodiment the modules are round, but in others (see FIG. 4) they may be substantially rectangular. The bristles are arranged such that the tufts are spaced to provide streaks of color in the hair. Also disclosed is a multi-channeled tray that coordinates with the bristle arrangements of the brush. In practice, it is desired that the modular brush is rotated within the tray to apply the desired colors to the bristles.

Hirsch, U.S. Pat. No. 5,507,063 discloses a hair coloring brush designed to solve the problem of previous hair streaking brushes that color in distinct streaks. The configuration of the bristles allows for less color to be applied by the shorter bristles relative to the longer bristles. The desired result is a blended, more natural high-lighted look.

Bonazza, U.S. Pat. No. 5,819,960 discloses a hair coloring easel. The easel includes a smaller center compartment located and configured to allow for drawing color from the smaller compartment to the larger with the aid of a channel between the two compartments. Additionally, the design of the tear-shaped compartments (tint bowls) also allows the user to easily "scoop" chemicals and/or colors from one compartment to the next.

Moore, U.S. Pat. No. 6,092,535 discloses a hair coloring tool that includes bristles arranged in a serrated pattern. This pattern is designed to provide a more natural coloring to the hair, in contrast to other tools that result in clearly demarcated lines of color. The handle of the tool may include a hook useful for insertion within a standard hair coloring cap.

One disadvantage of the aforementioned devices is that none of them provide a complete system with a minimum number of instruments.

Therefore, what is required is a hair coloring system that employs a brush that can be used to mix the hair colorings in addition to applying it to the hair.

Also, it is required to provide a hair coloring system that uses an applicator that can also prepare the hair prior to application of color.

In addition, it is required to provide a hair coloring system that comprises an applicator that includes a handle that can be used as a hair pick for sectioning the hair.

Further, it is required to provide a hair coloring system that includes a color tray comprising a desired number of color channels and color bowls.

It is also required to provide a method for using the applicator and the color tray in combination to provide a complete hair coloring system.

BRIEF SUMMARY OF THE INVENTION

Accordingly, what is provided is a hair coloring system that employs a brush that can be used to mix the hair colorings in addition to applying it to the hair. Also, provided is a hair coloring system that uses an applicator that can also prepare the hair prior to application of color. In addition, a hair coloring system is provided that comprises an applicator that includes a handle that can be used as a hair pick for sectioning the hair. Further, a hair coloring system is provided that includes a color tray comprising a desired number of color channels and color bowls. Also provided is a method for using the applicator and the color tray in combination to provide a complete hair coloring system.

The versatility of the channel coloring system is one of its strongest attributes. Any number of color combinations may be used, from a single color to many different colors. Highlighting, streaking, frosting and any application of color is within the scope of the present invention. A different color may be used within each channel, and additional colors may be used within the outer color bowls. This arrangement allows for countless color variations and styles, whether highlighting the hair with one or two colors, applying five or more colors simultaneously, or forming secondary colors due to the bleeding together of adjacent colors. The segregated bristle tufts on the brush allow for a more natural look because the colors are adjacent and applied to each layer of hair. This alleviates the problem of applying one color, and then having to switch brushes and trays for additional colors. The hair styling professional is able to do all of this with a single instrument, and a single color tray.

Additional features and limitations will be apparent from the accompanying detailed description and drawings.

DETAILED DESCRIPTION OF THE INVENTION

Figure 1:
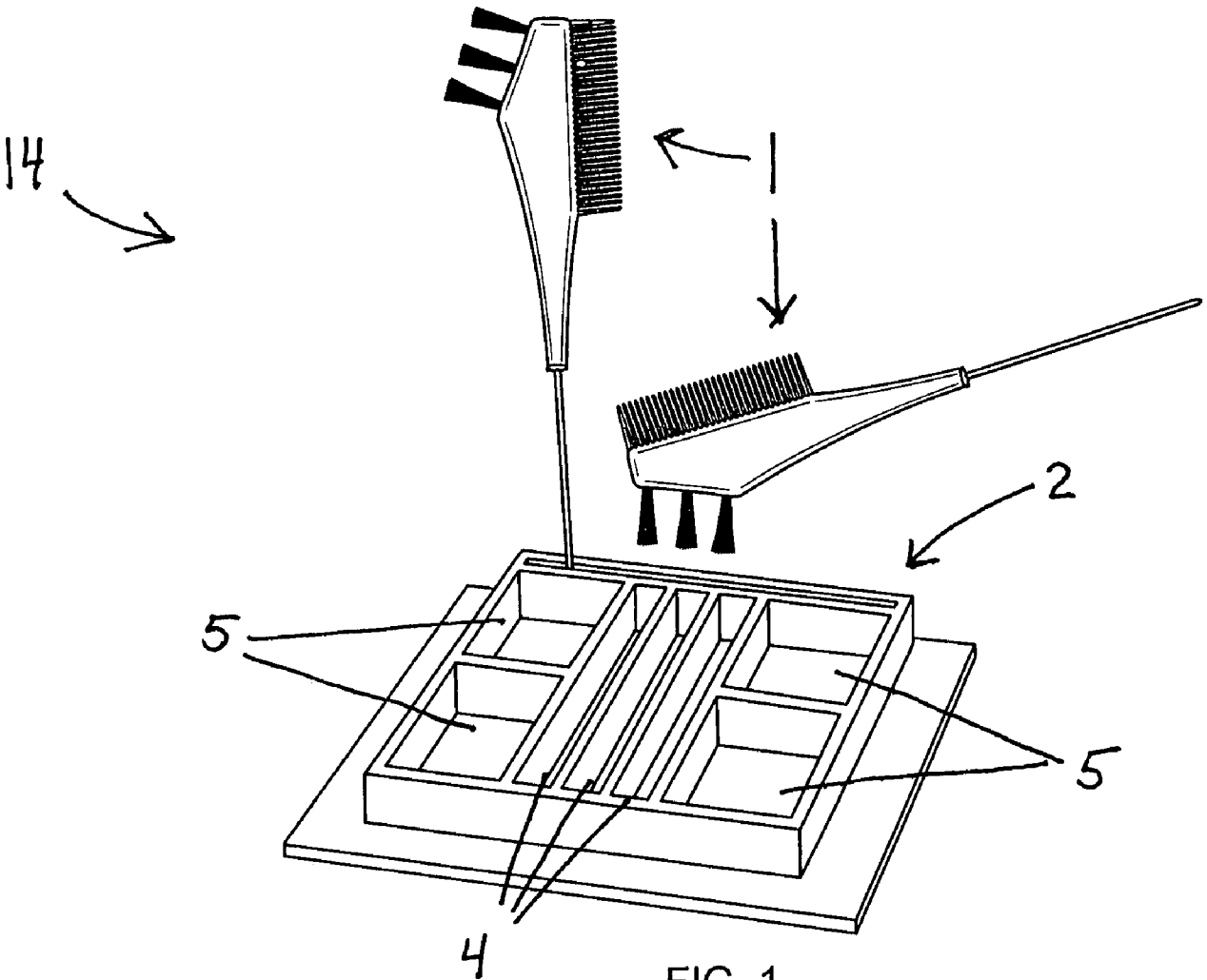
FIG. 1 is a perspective view of a three-channel embodiment and brushes of the present invention.
Figure 2:
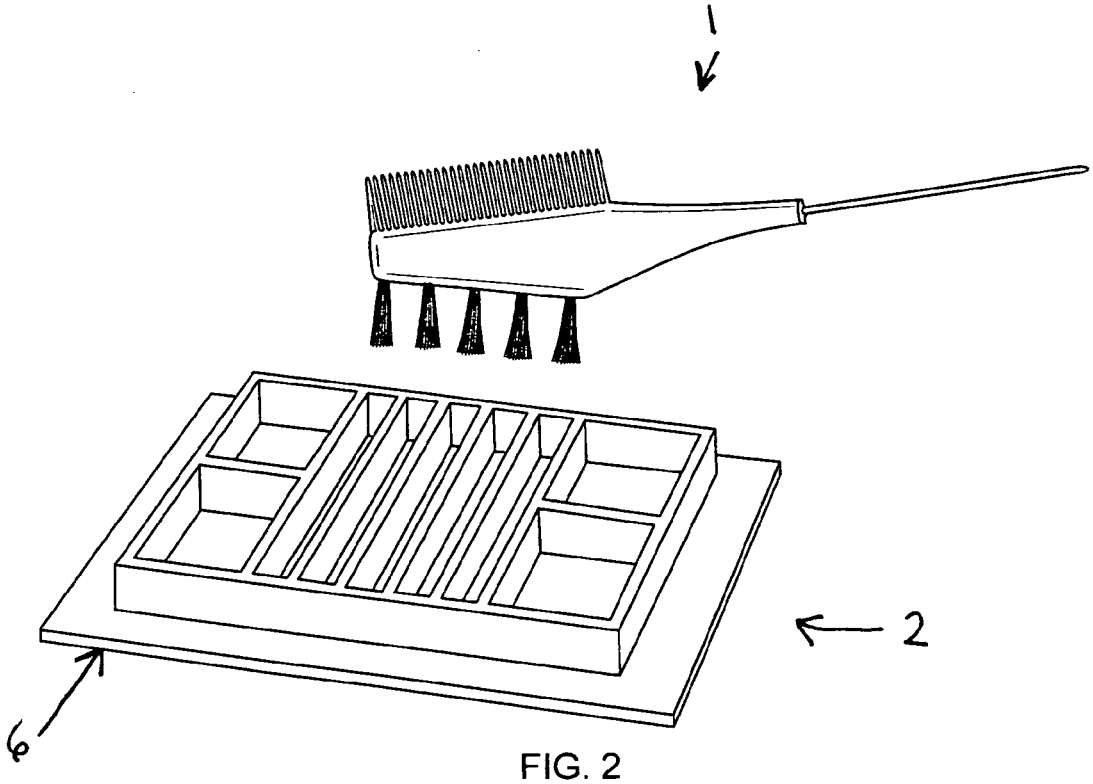
FIG. 2 is a perspective view of a five-channel embodiment and brush of the present invention.
Figure 3:
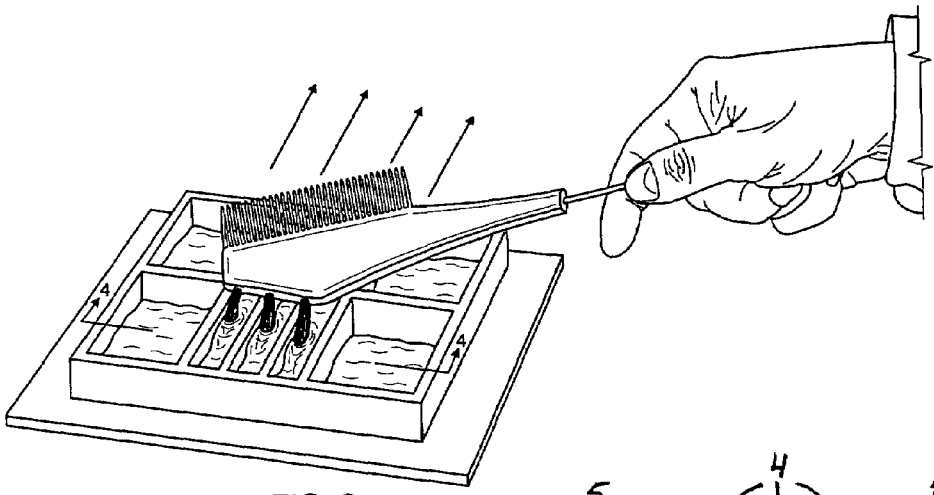
FIG. 3 is a perspective view of the present invention illustrating a user mixing the colors with a brush.
Figure 4:
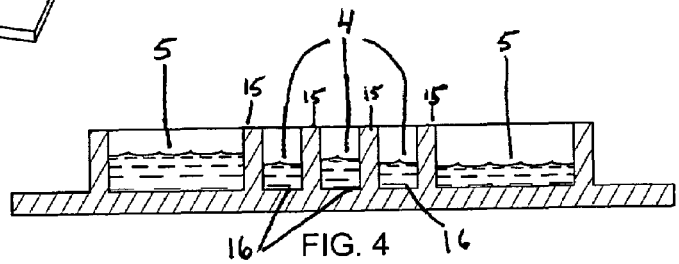
FIG. 4 is a side view of a cut-away aspect showing three channels and two of the single color bowls.
Figure 5:
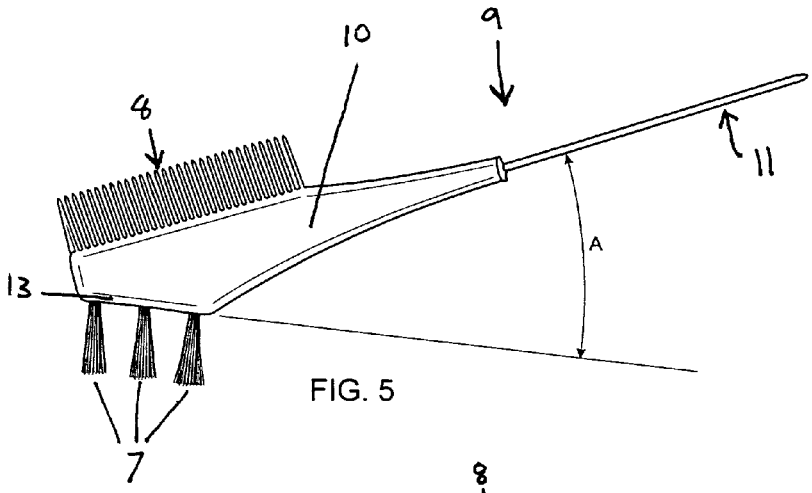
FIG. 5 is a side view of the applicator tool of the present invention displaying the three bristle group configuration.
Figure 6:
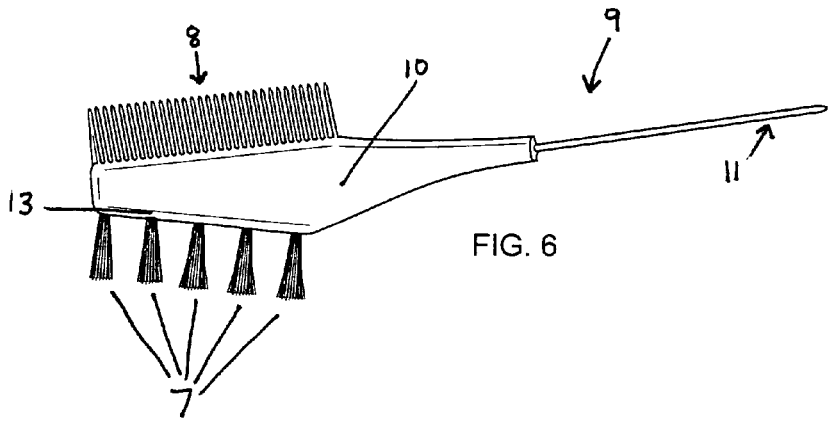
FIG. 6 is a side view of the applicator tool of the present invention displaying the five bristle group configuration.

The channel coloring system 14 comprises at least one applicator tool 1, and a color tray 2. The applicator tool 1 of the present invention is unique in the way that it combines many common styling elements into a single instrument. The applicator tool 1 includes a handle 9 that may also be used as a hair pick 11 for slicing or separating the hair. The hair pick 11 may be integral to the brush body 10, simply an extension of the brush body 10; with both brush body 10 and hair pick 11 comprising a plastic material, for example. In another embodiment, the handle 9 may comprise a hair pick 11 that comprises a material that differs from the material of the brush body 10, such as metal.

The handle 9 is also fashioned to properly fit within the brush storage region 12 of the color tray 2. This ensures that everything needed is always easily accessible and available to the hair styling professional. The brush angle A that is created between the plane that contains the handle 9 and the plane that contains the bristle attachment region 13 is preferably acute. The exact angle A measurement may vary, but an angle A between 85 degrees and 5 degrees is preferred, and an angle A that measures approximately 45 degrees, is optimal. Angle A is a carefully chosen design feature, the benefit of which is most easily recognized with use of the applicator tool 1, but may also be understood through careful study of the applicator tool 1 as it is used in mixing the color solutions, loading the applicator tool 1 with color, and/or applying color to the hair. The benefit may be understood by considering a prior art styling brush that does not include the angle A as claimed by the present invention. If the brush handle 9 and bristle attachment region 13 lie in the same plane, the hair-styling professional's hand would hit the color tray 2, possible spilling the various chemicals used during the coloring process; or at the very least, would impede the efficiency of the coloring process, possibly resulting in an undesired finish color. With the appropriate handle angle A, the hand of the hair professional is raised a suitable distance above the color tray 2, while the ends of the bristle groups 7 will lay substantially within a plane parallel to that of the color tray 2. This allows for free movement while mixing colors and loading the bristles, as well as when applying color to the hair.

The applicator tool 1 also includes a comb 8 that is integral to the brush body 10. In conjunction with the pick 11, the comb 8 may be used to ready the hair for coloring by assisting in sectioning, layering or any other standard comb uses as desired. Again, the key is that a single instrument can be utilized for all coloring functions with a simple flip or turn of the applicator tool 1.

The bristle groups 7 themselves must comprise materials that are stiff enough to properly mix the color within the channels, but must also include sufficient flexibility to properly load color and apply the color to the hair. The bristle groups 7 are attached to a bristle attachment region 13 in a manner sufficient to create the brush angle A mentioned above in any manner that is known in the art, such as being slightly recessed within the brush body 9 and secured with a glue or similar fastener. The bristle groups 7 are also preferably arranged in a segregated fashion. In this context, segregated means two or more bristle groups 7 are separated by a space. The bristle groups 7 may vary in the number of individual bristle members depending on the diameter of each bristle member, and the size of the group that is desired. The space between bristle groups 7 need only be large enough to allow for a channel wall 15 to pass through the space. In that regard, the bristle groups 7 should comprise a length that preferably at least reaches the channel bottom, or in terms of the channel walls 15, the bristle groups 7 should be at least as long as the channel wall height, but preferably slightly longer to allow for sufficient mixing of the colors. This is important because the color material will often comprise a greater density than the mixing material, which may be, for example, a peroxide solution. If the bristle groups 7 did not reach the channel bottom 16 a portion of the color would go unmixed, thereby possibly resulting in insufficient mixing of the color and peroxide solution. If it is desired to mix the color solution less than completely, the hair styling professional need only manually raise the bristle groups 7 slightly above the channel bottoms 16.

The present invention also comprises a color tray 2 that includes a plurality of channels 4, but the preferred embodiments include either three or five channels 4. The plurality of channels 4 are elongate, and are formed by channel walls 15 on either side of a channel bottom 16. The channel bottoms 16 may be either substantially flat or rounded. Adjacent channels 4 will normally share the channel wall 15 that is between them. Preferably, the channel coloring system 14 will be utilized such that an applicator tool 1 comprising three bristle groups 7 is used with a color tray 2 comprising three channels 4, but it would clearly be within the scope of the invention to use an applicator tool 1 that included only three bristle groups 7 with a five channel color tray 2. In the preferred embodiment, the color tray 2 also includes additional color bowls 5 on either side of the plurality of channels 4. In the simplest embodiment, the color bowls 5 will frame the plurality of channels 4 in a symmetrical fashion; two color bowls 5 on each side. In this way the color tray 2 will have a configuration that is easily manufactured, and easy to use.

The color tray 2 may also include a base 6. The base 6 may extend beyond the channel walls 15 and color bowls 5, creating a portion that may be gripped by the hair styling professional, or secured to an auxiliary retaining device. The perimeter of the base 6 may mirror the perimeter of the channels and color bowls, or may be shaped in any fashion so as to provide better comfort and/or security. For example, the base 6 could include curves or a ridge that enhances the ability of the hair styling professional to hold the color tray 2, or improve the ability to secure the color tray 2 to the auxiliary retaining device.

In a preferred embodiment, the color tray 2 would also include a brush storage region 12. The brush storage region 12 comprises portions that define an opening that is sufficient to insert the handle 9 of the applicator tool 1, as well as a variety of standard brushes, but the opening of the brush storage region 12 is small enough to provide sufficient friction to retain the brush or applicator tool 1. The frictional force that exists between the brush handle 9 and the brush storage region 12 should be sufficient to prevent a brush or applicator tool 1 from sliding out or falling over; yet brush storage region 12 must be loose enough to allow for easy removal and insertion of the brush/tool during the coloring process.

Also claimed is a method for coloring hair utilizing a channel coloring system 14. The hair may first be prepared via washing or wetting, if desired. The hair may then be combed and sectioned, preferably into four quadrants. A layer of hair is then separated with the pick 11 portion of the applicator tool 1; and the hair layer is preferably laid atop a piece of backing, comprising a rectangular piece of foil or other suitable material. The applicator tool 1 is then loaded with color and applied to the hair layer. The pick 11 may then be used to assist with folding the backing upwards, thereby enveloping the layer of hair for a desired amount of time. At this point, treatment may follow the standards for setting the color as is known in the art, such as wrapping the head, applying heat or other setting methods as desired. The pieces of backing may be removed and the hair prepared for final finishing in any manner desired as is known in the art.

In another embodiment the process comprises the preparation of the desired colors. The color preparation comprises depositing a first color within one of a plurality of channels 4. Typically this entails laying a bead of color along the channel bottom 16. Next, a peroxide solution is added that readies the color for application to the hair. This process may be repeated for as many channels as are present in the embodiment of the color tray 2 being used, or fewer as desired. At this point, the applicator tool 1 may then be employed, mixing all of the colors and the peroxide solution simultaneously. Once mixed to the desired point, the applicator tool 1 may then be loaded with a quantity of color. The loaded applicator tool 1 may then be applied directly to the hair, known as normal tint application on scalp, or the backings mentioned previously may be employed.

Another feature of the method of the present invention is the ability to create a secondary color. During application to the hair, adjacent colors will tend to bleed together due to the configuration of the bristle groups 7. Therefore, in the case of a three bristle group configuration that includes three different colors, two secondary colors may be formed by the bleeding together of the outer colors with the inner color. A subsequent application stroke will result in the first color bleeding into the third color, thereby creating a third secondary color. Therefore, for three colors, a total of six colors will be realized by the final application if only adjacent applications are used. If any type of overlap is utilized during application, even more color variations may be created. This can be easily understood via the following color chart, where $C_{1-3}$ represent primary colors located within the color tray, and $C_{4-6}$ represent secondary colors created by the bleeding of the colors. The total number of colors possible also increases with the increase in the number of colors utilized in the color tray 2.

TABLE

| | | | | | | |
|---|---|---|---|---|---|---|
| $C_1$ | | $C_2$ | | $C_3$ | | $C_1$ |
| | $C_4$ | | $C_5$ | | $C_6$ | |

The specific order of the steps is not entirely crucial, in that the color mixture may be prepared prior to preparation of the hair, or vice versa. Obviously, steps such as applying the color to the hair would be subsequent to the step of preparing the hair for color, but these types of variations are well within the knowledge of persons of ordinary skill in the art.

Although the present invention has been described with reference to particular embodiments, it will be apparent to those skilled in the art that variations and modifications can be substituted therefore without departing from the principles and spirit of the invention.

What is claimed is:

1. A method for modifying hair color, the method comprising the steps of:

preparing the hair;

separating a section of hair;

utilizing a hair color containment apparatus possessing a multiplicity of equidistantly spaced coincident rectangular channels disposed to contain a multiplicity of hair coloring products;

utilizing a hair tool possessing a multiplicity of removably attachable bristle groups;

loading at least two of said multiplicity of equidistantly spaced coincident rectangular channels with a differing hair coloring of said multiplicity of hair coloring products;

loading at least two of said multiplicity of equidistantly spaced coincident brush applicator groups with each of said differing hair coloring of said multiplicity of hair coloring products by utilizing said equidistantly spaced coincident rectangular channels said hair color containment apparatus;

applying said each of said differing hair coloring of said multiplicity of hair coloring products to said prepared section of hair wherein a secondary mix color is formed due bleeding together of adjacent colors upon contact with said hair and a singular movement of said applicator; and setting said secondary mixed color.

2. The method for modifying hair color of claim 1 further comprising:

loading three of said multiplicity of equidistantly spaced coincident rectangular channels with a differing hair coloring of said multiplicity of hair coloring products;

loading three of said multiplicity of equidistantly spaced coincident brush applicator groups with each of said differing hair coloring of said multiplicity of hair coloring products by utilizing said equidistantly spaced coincident rectangular channels said hair color containment apparatus;

applying said each of said differing hair coloring of said multiplicity of hair coloring products to said prepared section of hair wherein a secondary mix color is formed due bleeding together of adjacent colors upon contact with said hair and a singular movement of said applicator; and setting said secondary mixed color.

3. The method for modifying hair color of claim 2 further comprising:

loading four of said multiplicity of equidistantly spaced coincident rectangular channels with a differing hair coloring of said multiplicity of hair coloring products;

loading four of said multiplicity of equidistantly spaced coincident brush applicator groups with each of said differing hair coloring of said multiplicity of hair coloring products by utilizing said equidistantly spaced coincident rectangular channels said hair color containment apparatus;

applying said each of said differing hair coloring of said multiplicity of hair coloring products to said prepared section of hair wherein a secondary mix color is formed due bleeding together of adjacent colors upon contact with said hair and a singular movement of said applicator; and setting said secondary mixed color.

4. The method for modifying hair color of claim 2 wherein an individual of said multiplicity of removably attachable bristle groups do not contact any other individual of said multiplicity of removably attachable bristle groups.

5. The method for modifying hair color of claim 4 wherein said multiplicity of removably attachable bristle groups are equidistantly spaced.

6. The method for modifying hair color of claim 5 wherein distances between said multiplicity of removably attachable bristle groups are substantially equal to the width of a channel.

7. The method for modifying hair color of claim 1 wherein said hair color containment apparatus further comprises a brush storage area including a plurality of brush storage cavities disposed such that said handle of said at least one applicator tool is retained in a vertical disposition.

* * * * *